United States Patent [19]

Stivers

[11] Patent Number: 4,892,028

[45] Date of Patent: Jan. 9, 1990

[54] FLUID OPERATED CIRCUIT FOR CONTROLLING A DUAL POST HYDRAULIC LIFT ASSEMBLY

[75] Inventor: Bernard R. Stivers, Louisville, Ky.

[73] Assignee: VBM Corporation, Louisville, Ky.

[21] Appl. No.: 648,503

[22] Filed: Sep. 10, 1984

[51] Int. Cl.[4] ..... B66F 3/46; B66F 7/04; B66F 7/20

[52] U.S. Cl. ..... 91/517; 91/518; 91/520; 91/420; 254/89 H

[58] Field of Search ..... 91/171, 189 R, 520, 91/420, 421, 445, 513, 517, 518; 60/546; 254/2 B, 2 C, 9 C, 89 H; 137/456, 494

[56] References Cited

U.S. PATENT DOCUMENTS

| | | | |
|---|---|---|---|
| 840,312 | 1/1907 | Goodfellow | 137/456 X |
| 1,894,020 | 1/1933 | Chance | 91/189 X |
| 2,764,869 | 10/1956 | Scherr | 91/171 |
| 3,382,771 | 5/1968 | Nutter | 91/517 |
| 3,430,540 | 3/1969 | Linz | 91/420 |
| 3,630,216 | 12/1971 | Kelly | 137/456 X |
| 3,636,817 | 1/1972 | Shapiro | 91/171 |
| 3,665,810 | 5/1972 | Parrett | 91/420 |
| 3,757,899 | 9/1973 | Smith | 91/171 X |
| 3,832,852 | 9/1974 | Schmucker | 60/547.1 X |
| 3,871,266 | 3/1975 | Schwab et al. | 91/517 |
| 3,990,583 | 11/1976 | Nishida et al. | 91/420 X |
| 4,266,749 | 5/1981 | Lundstrom | 91/520 X |
| 4,343,226 | 8/1982 | De Almeida | 91/520 X |
| 4,354,688 | 10/1982 | Swanson | 91/520 X |
| 4,500,071 | 2/1985 | Bagwell et al. | 254/423 |
| 4,505,455 | 3/1985 | Beatty | 254/89 H |

FOREIGN PATENT DOCUMENTS

| | | | |
|---|---|---|---|
| 1162654 | 2/1964 | Fed. Rep. of Germany | 137/494 |
| 3235829 | 3/1984 | Fed. Rep. of Germany | 254/2 C |
| 724273 | 2/1955 | United Kingdom | 91/171 |
| 1150667 | 4/1969 | United Kingdom | 91/171 |
| 1395222 | 5/1975 | United Kingdom | 137/494 |

OTHER PUBLICATIONS

ANSI Graphic Symbols: Fluid Power Diagrams, ANSI.

*Hydraulic Handbook* 2nd Ed., Trade & Technical Press Ltd.: Surrey, England 9/1960, p. 378.

*Primary Examiner*—Robert E. Garrett
*Assistant Examiner*—George Kapsalas
*Attorney, Agent, or Firm*—Maurice L. Miller Jr.

[57] ABSTRACT

A fluid operated circuit for controlling the movement of pistons contained in the drive and idler cylinders of a conventional dual post vehicle lift assembly of the type wherein the cylinders are hydraulically connected in tandem so that movement of the idler cylinder piston is dependent upon movement of the drive cylinder piston and wherein the pistons, while operative to lift and lower movable article supporting structures, are not fixedly connected thereto. The circuit employs a pilot operated check valve responsively connected to the lower ends of the two cylinders for preventing the drive cylinder piston from descending when the article supporting structure associated with the idler cylinder is locked or jammed in an elevated postion, a first tow-position control valve for perventing the drive cylinder piston from descending when the article supporting structure associated with the drive cylinder is locked or jammed, a simple check valve connected in shunting relation across the first control valve for restoring the latter to an open state after it has closed, and a second two-position control valve which is manually operated as desired to drain hydraulic fluid from the drive cylinder to permit lowering of the pistons and their associated article supporting structures so long as both of the latter are free of restraint.

11 Claims, 1 Drawing Sheet

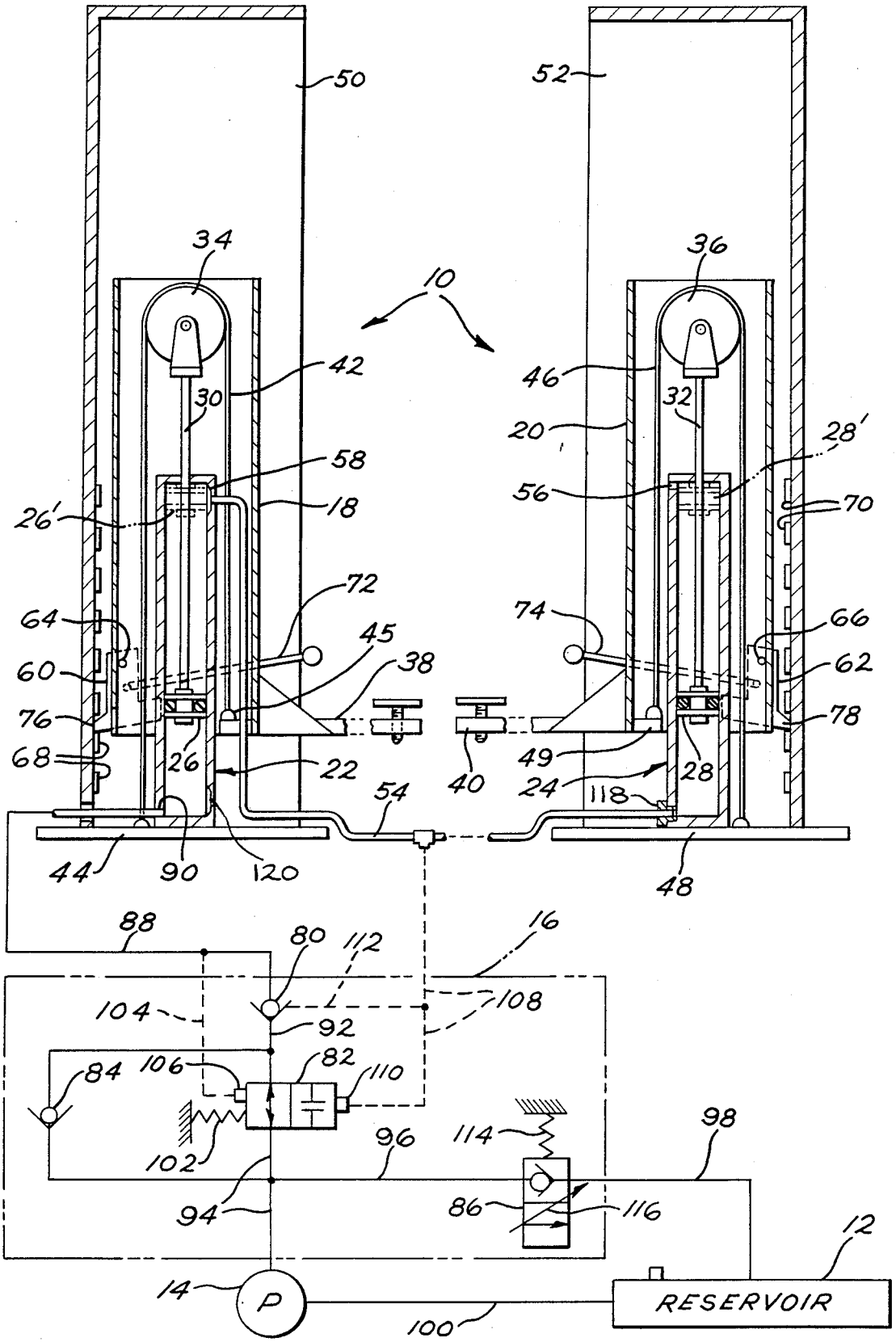
50
52
34
36
10
42
46
30
32
20
28'
58
56
26'
18
70
72
74
64
45
66
60
38
62
76
78
68
26
22
49
28
40
24
118
54
44
90
120
48
88
80
112
16
104
108
92
84
106
82
110
102
96
114
98
94
86
116
12
14
P
RESERVOIR
100

FLUID OPERATED CIRCUIT FOR CONTROLLING A DUAL POST HYDRAULIC LIFT ASSEMBLY

BACKGROUND OF THE INVENTION

My invention relates generally to a fluid operated circuit for controlling the ascent and descent of the pistons of a pair of hydraulically operated cylinders of a dual post article lift assembly. More specifically, my invention relates to a fluid operated circuit for preventing the descent of such pistons when one of the movable article supporting structures associated with the cylinders is blocked, jammed or otherwise restrained from descending while the other is free to do so.

One type of prior art dual post article lift assembly is characterized by a hydraulically operated driven or drive cylinder containing a movable piston connected to a piston rod and hydraulically operated slave or idler cylinder also containing a movable piston connected to a piston rod. The drive and idler cylinders are hydraulically connected together for the transfer of hydraulic fluid therebetween such that upward and downward movements of the idler cylinder piston are dependent upon and controlled by similar movements of the drive cylinder piston. Raising and lowering of both pistons is accomplished by pumping hydraulic fluid into and draining hydraulic fluid from a lower end of the drive cylinder below the lowest attainable position of the drive cylinder piston. Article supporting structures including a pair of carriage arms are connected to each of the piston rods for lifting and lowering massive articles such as vehicles, for example, as the pistons are raised and lowered.

In some prior art dual post assemblies of this type, the article supporting structures are fixedly connected to the piston rods so that each of the structures always moves as the corresponding piston to which it is rigidly connected moves. However, because each of the supporting structures is operated independently of the other by a different one of the cylinders, problems have been encountered in maintaining proper alignment between them as they are lifted and lowered and especially when lowered. Failure to maintain adequate alignment of a vehicle on such a lift while it is lifted and lowered can obviously produce disasterous results. The problem has been dealt with in the case of dual post lifts adapted for below ground disposition by use of a rigid bar connected between the piston rods and/or between the supporting structures whereby neither of the pistons, rods or their attached article supporting structures can move unless the other does so. See, for example, the device disclosed in U.S. Pat. No. 1,982,936 issued to L. C. Stukenborg on Dec. 4, 1934. While such rigid attachment between the rods and/or their article supporting structures may be feasible for use with below ground dual post lift assemblies, the same is impractical for use with modern above-ground dual post lifts because the rigid interconnecting member tends to get in the way of the vehicle or other article being lifted.

To address this problem in above-ground lifts, resort has been had in the prior art to the use of a chain connected between the movable article supporting structures of each cylinder which is strung through a series of pulleys connected to the stationary housings covering the cylinders at levels above and below the highest and lowest attainable positions of article supporting carriage arms of the structures so that one structure can not move unless the other does so. While the chain can thus be strung so as to avoid interfering with the vehicle being lifted, it is necessary to string the same across a floor which forms the drive way for the vehicle between the two housings of the lift apparatus. This requires placing an elongated steel cover having beveled or tapered sides over the chain so as to permit passage of the wheels of the vehicle to be lifted thereover when approaching and leaving the lifting position. It is clearly desirable therefore to find satisfactory means for maintaining carriage arm alignment without using such a chain.

Another type of prior art above-ground dual post lift employs hydraulic cylinders whose pistons and attached piston rods are not fixedly connected to the lifting structure. Most modern lifts have a pulley connected to the upper end of each piston rod over which extends a chain connected between a lower end portion of the corresponding movable supporting structure and a base or support plate upon which the corresponding stationary cylinder housing is disposed. The attached drawing FIGURE shows such a prior art arrangement. As the piston rod of each cylinder is lifted and lowered by a given distance, the pulley associated therewith travels along the corresponding chain to lift and lower the corresponding article support structure by twice that distance. Accordingly, for a given height of maximum lift, the subject cylinders need only be about half as long as they would otherwise need to be in cases where the piston rods are fixedly connected directly to the movable supporting structure. In this type of lift, the movable article supporting structures ascend as the pistons ascend, but the pistons are free to descend independently of the supporting structure and may do so even though the supporting structures are locked, jammed, blocked or otherwise restrained from descending from an elevated position. Consequently, if one of the supporting structures is jammed at an elevated position while the other is free to descend when hydraulic fluid is drained from the drive cylinder, the carriage arms of the supporting structure can become seriously misaligned, sometimes with tragic results.

For many years it has been readily apparent that the problems of carriage arm misalignment in these above-ground dual post lift assemblies, particularly during descent, could probably best be solved by fully hydraulic means if a suitable fluid circuit for sensing and reacting to impending carriage arm misalignment could be devised. Unfortunately this problem has long plagued the prior art without a satisfactory solution.

By means of my invention, these and other difficulties encountered with above-ground, dual post lift assemblies have now been substantially overcome.

SUMMARY OF THE INVENTION

It is an object of my invention to provide a fluid operated circuit for controlling a dual post hydraulically operated article or vehicle lift assembly.

It is a further object of my invention to provide a fluid operated circuit for preventing the descent of the pistons contained in the drive and idler cylinders of a dual post article lift assembly when one of the movable article supporting structures associated with the cylinders is blocked, jammed or otherwise restrained from descending.

Briefly, in accordance with my invention, I provide a fluid operated circuit for use with a dual post article lift assembly. The assembly with which my circuit is used includes hydraulically operated drive and idler cylinders, both of which contain the usual movable piston connected to a piston rod, the cylinders being hydraulically connected such that movement of the idler cylinder piston is dependent upon movement of the drive cylinder piston. The assembly also includes a pair of article supporting means which are non-fixedly connected to the cylinder rods such that upward movement of each piston produces upward movement of the article supporting means associated therewith but such that downward movement of each piston can occur independent of such movement in the corresponding article supporting means. The circuit of my invention comprises first valve means connectable for fluid flow therethrough to a lower end of the drive cylinder and responsively connectable to both of the cylinders for preventing the drive piston from descending when the supporting means associated with the idler cylinder is restrained from descending. The circuit also comprises second valve means connected for fluid flow therethrough to the first valve means and being responsively connectable to lower ends of both of the cylinders for preventing the drive piston from descending when the supporting means associated with the drive cylinder is restrained from descending.

These and other objects, features and advantages of my invention will become apparent to those skilled in the art from the following detailed description and attached drawing in which, by way of example, only a preferred embodiment of my invention is described and illustrated.

BRIEF DESCRIPTION OF THE DRAWING

The sole drawing FIGURE shows an elevation view of a conventional dual post article lift assembly with parts torn away for viewing clarity and a schematic diagram of a fluid operated circuit used for controlling the operation of the lift assembly, thus illustrating a preferred embodiment of the fluid circuit of my invention.

DESCRIPTION OF THE PREFERRED EMBODIMENT

Referring now to the drawing, there is shown a conventional hydraulic fluid operated, dual post vehicle lift assembly 10. Hydraulic fluid for operating the assembly 10 is supplied thereto from a suitable reservoir 12 by means of a conventional electric pump 14. A novel fluid circuit 16 controls the flow of hydraulic fluid to and from the assembly 10 to enable the latter to raise and lower a vehicle or other massive article (not shown) supported thereby. Before describing the elements and features of the circuit 16, the conventional structure of the assembly 10 will first be explained.

The assembly 10 includes a pair of vertically movable lifting posts 18, 20 having hollow interiors and being open on upper and lower ends thereof. The posts 18, 20 of the present example are of rectangular shape as viewed in plan. Also included is a double acting hydraulically operated drive cylinder 22 and a single acting hydraulically operated idler or slave cylinder 24 having the usual movable pistons 26, 28, respectively, connected to piston rods 30, 32, respectively. The posts 18, 20 are disposed over and around the cylinders 22, 24, respectively, and the upper ends of the rods 30, 32 are connected to pulleys 34, 36, respectively. A pair of carriage arms 38, 40 are fixedly attached on their outer ends to lower end portions of the posts 18, 20 and extend inwardly toward one another in cantilevered fashion for supporting a vehicle or other massive article (not shown) on the free opposing ends thereof. A chain 42 is strung over the pulley 34 and connected to and between a base or supporting plate 44 and an outward end 45 of the arm 38 near the base of the post 18. Similarly, a chain 46 is strung over the pulley 36 and connected between a supporting plate 48 and an outward end 49 of the arm 40. A pair of box-shaped housings 50, 52 is disposed on the plates 44, 48, respectively, over the posts 18, 20 and cylinders 22, 24 which contain open inwardly facing vertical sides for permitting the carriage arms 38, 40 to extend therethrough. Upper surfaces of the housings 50, 52 are located so as to provide adequate clearance from the tops of the posts 18, 20 when the latter are raised to their maximum heights.

A fluid flow line 54 is connected between an upper end of the drive cylinder 22 and a lower end of the idler cylinder 24 for transferring hydraulic fluid back and forth therethrough to raise and lower the idler cylinder piston 28. A vent port 56 permits an upper end of the interior chamber of the idler cylinder 24 to communicate with outside ambient atmosphere for allowing the piston 28 to be raised and lowered as desired. A vertically extending slot 58 is formed in an interior surface portion of the wall of the drive cylinder 22 which extends across the vertical side of the piston 26 and beyond the upper and lower surfaces thereof when the latter is forced to the top of its stroke by the pump 14 as shown in phantom at 26'. The line 54 connects to the cylinder 22 so as to communicate with the slot 58. Consequently, when the piston 26 reaches the top of its stroke as at 26', an additional quantity of hydraulic fluid can be pumped by the pump 14 through the circuit 16 into the lower end of the drive cylinder 22 to force a like quantity of fluid into the slot 58, flow line 54 and lower end of the idler cylinder 24 as needed to drive the piston 28 to the top of its stroke as shown in phantom at 28'. The cylinders 22, 24 are designed in the usual manner such that the drive piston 26 always reaches the top of its stroke slightly before the idler piston 28 reaches the top of its stroke. In this manner, the piston 28 can always be driven to the top of its stroke each time the piston 26 reaches the top of its stroke. Accordingly, the carriage arms 38, 40 can always be brought into alignment with one another each time the pistons 26, 28 are driven to their maximum heights as well as when they are lowered to the base of the housings 50, 52.

The assembly 10 also includes a pair of suitable latch means for mechanically securing the posts 18, 20 to the outer walls of the housings 50, 52 at various selected elevated positions to prevent sudden and unwanted descent of either or both of the posts for any reason such as, for example, by reason of the sudden loss of hydraulic fluid support of one or both of the pistons 26, 28. In the present example, such latch means includes a pair of latch members 60, 62 pivotally connected on upper end portions thereof by means of pins 64, 66 to lower end portions of the vertical rear walls of the posts 18, 20. Also included are two sets of spaced blocks 68, 70 arranged in vertical columns and secured to the interior surfaces of the outer walls of the housings 50, 52, and a pair of manually adjustable latch handles 72, 74 pivotally connected to the latch members 60, 62, respectively, below the level of the pivot pins 64, 66. The latch handles 72, 74 are accessible to an operator of the assembly 10 through the opposing open sides of the housings 50, 52. When the handles 72, 74 are in the position shown, the members 60, 62 are free to swing on the pins 64, 66. The centers of gravity of the members 60, 62 are such that when the handles 72, 74 are in the positions shown, lower end portions or toes 76, 78 of the members tend to engage the outer walls of the housings 50, 52 in line with the blocks 68, 70 and tend to slide along the outer housing walls and over and across the blocks as the posts 18, 20 are raised, thereafter swinging back against the outer walls in between adjacent blocks. However, should hydraulic fluid be lost from either or both cylinders 22, 24 when the posts 18, 20 are in elevated positions with the handles 72, 74 in the position shown, the toes 76, 78 will fall into and against the upper surfaces of the blocks 68, 70 just below the lower end of the toes 76, 78 at the time such fluid support is lost to prevent further descent of the posts 18, 20. To lower the posts 18, 20, the latch handles 72, 74 must be pulled inwardly of the assembly 10 as viewed from the positions shown so as to force the toes 76, 78 to swing inwardly of the assembly 10 away from engagement with the blocks 68, 70. Having thus described the features of the conventional assembly 10, reference is now made to the fluid circuit 16 representing a preferred embodiment of my invention.

The circuit 16 includes a pilot operated check valve 80, a first two-position control valve 82 having an open and a closed state, a fluid by-pass valve means consisting of a simple check valve 84, a second two-position control valve 86, also having an open and a closed state, and means for biasing the valves 82 and 86 as later more fully explained. One end of the valve 80 is connected through a flow line 88 to a port 90 which communicates with the lower end of the interior chamber of the drive cylinder 22 below the lowest attainable position of the piston 26. The other end of the valve 80 is connected through a flow line 92 to one end of the valve 82, the other end of which is connected through a flow line 94 to the pump 14 and also through a portion of the line 94 and a flow line 96 to one end of the valve 86. The other end of the valve 86 is connected through a flow line 98 to the reservoir 12. Hydraulic fluid to be supplied to the cylinder 22 is drawn from the reservoir 12 to the pump 14 through a flow line 100. The valve 84 is connected in parallel with or shunting relation across the valve 82. The valve 82 is biased to its open state as shown by a spring biasing means 102 and a fluid biasing means consisting of a fluid pressure sensing line 104 connected between the line 88 and a blind port 106 on one side of the valve 82. The valve 82 also utilizes counterbiasing means consisting of a fluid pressure sensing line 108 connected between the flow line 54 and a blind port 110 located on the side of the valve 82 opposite the spring biasing means 102 and fluid biasing means 104, 106. A fluid pressure sensing line 112 is connected between the line 108 and a pilot port of the check valve 80 for sensing fluid pressure in the lower end of the idler cylinder 24. The valve 86 is biased by means of a spring 114 to its closed state as shown and is manually switchable in opposition to the spring 114 to its open state by means of a lever 116. The pressure sensing lines 104, 108 and 112 are shown as dashed lines to distinguish them from the various fluid flow lines, which latter lines are shown as solid lines.

In operation, the circuit 16 functions in association with the reservoir 12 and pump 14 to raise and lower the posts 18, 20 of the assembly 10 as follows. Assume initially that the posts 18, 20 are in their fully lowered positions resting upon the plates 44, 48, respectively, and that the cylinders 22, 24 have not been previously used so that no residual hydraulic fluid is present in the cylinder 22 above the piston 26, the flow line 54 or the lower end of the cylinder 24. The carriage arms 38, 40 should be empty of any load under these conditions. A conventional bleeder valve or nut 118 connecting the line 54 to the cylinder 24 should be loosened sufficiently so that air trapped in the cylinder 22 above the piston 26 and the line 54 can be bled to ambient atmosphere when the piston 26 and the line 54 can be bled to ambient atmosphere when the piston 26 is raised initially. The operator activates the pump 14 to draw hydraulic fluid from the reservoir 12 through the line 100, pump 14 and line 94. The valve 82, being normally open as shown, allows the fluid to be pumped therethrough and through the line 92, the check valve 80 and line 88 to begin filling the lower end of the drive cylinder 22 to thus raise the piston 26. Eventually, the piston 26 is driven to the top of its stroke as at 26' at which time additional fluid overflows the slot 58 around the side of the drive piston at 26' into the line 54 and lower end of the idler cylinder 24 to initiate upward movement of the piston 28. At this point in time virtually all of the air previously entrapped beyond the top of the piston 26 and in the line 54 will have been bled out of the system and replaced by hydraulic fluid as will be evidenced by the commencement of hydraulic fluid leakage around the loosened valve or nut 118, whereupon the valve or nut 118 should be tightened to form a fluid tight seal between the end of the line 54 and the cylinder 24. The process of filling the idler cylinder 24 and line 54 with hydraulic fluid should be continued until the piston 28 also reaches the top of its stroke at 28' at which time the pump 14 is shut down. Thereafter, as the posts 18, 20 are lowered, hydraulic fluid will flow from the base of the cylinder 24, through the line 54 and into the upper end of the cylinder 22 above the piston 26 as the latter descends.

To initiate descent of the pistons 26, 28 and posts 18, 20, the valve 86 is switched to its open state opposite the position shown. The pilot operated valve 80 is selected so that it will open to permit drainage of hydraulic fluid from the drive cylinder 22 so long as the pressure of the hydraulic fluid in the lower end of the cylinder 24 and line 54, as sensed along lines 108 and 112, is at least equal to between about one-sixth and one-fourth of the pressure of the hydraulic fluid in the lower end of the drive cylinder 22 and line 88, although some deviation above and below these limits may be found permissible for such valve operation in some circumstances. I believe that the valve 80 should be set to open when the above referenced pressure ratio is about 1:4 for optimum results. The difficulty that can be encountered when the valve 80 is allowed to open for descent of the pistons 26, 28 for pressure ratios which are too low, i.e. lower than about one-sixth, is that the valve 80 may not close as desired when the post 20 becomes restrained from descending, a result that could be disasterous as later more fully explained. If such ratio is much greater than 1:4, the valve 80 may not open to lower the pistons 26, 28 when desired, even though the post 20 is free to descend and is not restrained.

Assuming for the moment that the ratio of fluid pressure in the lower end of the cylinder 24 to the fluid pressure in the lower end of the cylinder 22 is at least equal to the operating ratio for which the valve 80 is set to open, the valve 80 will do so to permit drainage of fluid therethrough from the lower end of the cylinder 22 and line 88. Under these circumstances, the valve 82 will also be open since the fluid pressure in the lower end of the cylinder 22 and line 88 as transmitted along line 104 to the blind port 106, plus the bias pressure of the spring 102, will override the counterbiasing pressure of the fluid in the lower end of the cylinder 24 and line 54 as transmitted along line 108 to the blind port 110. Accordingly, with the valve 86 being held by the operator in its open state as aforesaid, fluid will be drained from the lower end of the cylinder 22 through the line 88 and open valves 80, 82 and 86 to the reservoir 12, whereby the piston 26 and post 18 will descend. At the same time, downward bearing pressure of the piston 28 upon fluid in the cylinder 24 will force the same out of the lower end of that cylinder, through the line 54 and slot 58 into the upper end of the cylinder 22 over the descending piston 26, whereby the piston 28 will also descend.

Now, suppose that at some point during this descent process the post 20 becomes jammed for some reason so that the post 18 and piston 26 tend to continue in unrestrained descent while the post 20 and carriage arm 40 become stationary. Such a condition would occur at the point in time when descent of the posts 18, 20 from an elevated position is initiated in the event the operator had previously disengaged the latch member 60 from contact with one of the column of blocks 68 but has inadvertently failed to disengage the latch member 62 from contact with a corresponding one of the column of blocks 70. This condition would also occur during the descent process in the event a foreign object such as a portable tool cabinet, tool box or piece of service equipment was inadvertently left under the carriage arm 40 so that, as the post 20 descends, the carriage arm 40 comes down into contact with the object, whereby the post 20 and piston 28 become restrained from further descent while the post 18 and piston 26 remain free to continue descending. Under such conditions, the pressure of the hydraulic fluid under the piston 28 in the lower end of the idler cylinder 24 and line 54 will drop to or nearly to 0 psi while fluid pressure in the drive cylinder 22 under the piston 26 and in the line 88 will remain relatively high, whereby the ratio of the former of these two fluid pressures to the latter will decrease by a substantial amount below the operating ratio of the valve 80 to cause the same to shift to its closed state. Accordingly, drainage of hydraulic fluid from the lower end of the cylinder 22 to the reservoir 12 will be immediately stopped to halt the descent of the post 18 and piston 26 thus keeping the carriage arms 38, 40 from becoming misaligned to such an extent that a vehicle or other article, thereon might roll counterclockwise as viewed and fall from the assembly 10. Thus, the valve 80 functions to stop the unrestrained post 18 and carriage arm 38 and the piston 26 from descending at any time it senses that the post 20 and carriage arm 40 have become restrained from descending. This action of the valve 80 will also prevent the piston 28 from drifting downward under its own weight and that of the rod 32, pulley 36 and chain 46 because the idler piston 28 can not move unless the piston 26 moves.

Next, assume an attempt is made to lower the posts 18, 20 from an elevated position while the post 18 and carriage arm 38 are restrained from descent. Such a condition would exist where the operator has unlocked the latch member 62 from the blocks 70 but has forgotten to unlock the latch member 60 from the blocks 68, whereby the post 18 and piston 26 are restrained from descending while the post 20 and carriage arm 38 are free to descend. Upon shifting the valve 86 to its open state opposite the position shown under these circumstances, the piston 28 will start to descend by forcing hydraulic fluid out of the lower end of the cylinder 24, through the line 54 and slot 58, into the upper end of the cylinder 22. Since the fluid pressure in the lower end of the cylinder 24 and line 54 will be high relative to the pressure of hydraulic fluid in the cylinder 22 below the piston 26, the valve 80 will remain open for drainage of the fluid therethrough. However, the counterbiasing fluid pressure in the line 108 pressing against the blind port 110 of the valve 82 will override the combined biasing pressures of the spring 102 and the low fluid pressure transferred through the line 104 against the blind port 106, whereby the valve 82 will shift to its closed state opposite the position shown. Thus, drainage of fluid from the base of the cylinder 22 into the line 88 and ultimately to the reservoir 12 will be stopped so that further drainage of fluid out of the base of the cylinder 24 will not occur. As a result, descent of the post 20, piston 28 and carriage arm 40 is prevented when the post 18 and carriage arm 38 is jammed. It will be perceived that even when the post 18 and arm 38 are restrained, there will still be some pressure in the bottom of the cylinder 22 and line 88 due to the weight of the piston 26, rod 30, pulley 34 and chain 42, but so long as biasing pressure of the spring 102 is not greater than about 600 psi, the first mentioned pressure will not be great enough to keep the valve 82 from closing. Without such intervention by the valve 82, the piston 26 would continue to descend due to the weight of the chain 42, pulley 34, rod 30 and piston 26 bearing upon the fluid in the lower end of the cylinder 22 while the restrained post 18 and carriage arm 38 would be left in an elevated locked position. This would, in turn, cause the piston 28 and the unrestrained post 20 to descend thus allowing any load on the arms 38, 40 to tilt or rotate in a clockwise direction as viewed possibly allowing the load to fall from the lift.

To reset the valve 82 to its normally open position after the post 18 and carriage arm 38 have been freed from the condition preventing their descent, the pump 14 is energized with the valve 86 closed to force hydraulic fluid through a portion of the line 94 and through the by-pass check valve 84 into the line 92 on the other side of the closed valve 82. This, in turn, opens the valve 80 to force fluid through the line 88 into the lower end of the cylinder 22 to lift the piston 28 slightly and increase the fluid pressure in the line 88. Accordingly, as high pressure is restored in line 88, the fluid bias pressure as transmitted from the line 88 through the line 104 to the blind port 106 is likewise restored to shift the valve 82 with the aid of the spring bias means 102 back to the normally open position. The pump 14 is then de-energized and the valve 86 may be manually opened to cause the pistons 26, 28 and posts 18, 20 to descend in a normal coordinated manner.

I have also found that the maximum ratio of fluid pressure in the lower end of the cylinder 24 and line 54 to the fluid pressure in the lower end of the cylinder 22 and line 88 for which the valve 80 should be set to open is about 1:4. An operating ratio of much greater than this amount can cause the valve 80 to fail to open to permit descent of the posts 18, 20 in some cases even though the post 20 and carriage arm 40 is completely unrestrained and free to descend upon command. This is because the level of fluid pressure in the cylinder 24 and line 54 will probably never be much greater than about one-fourth the level of fluid pressure in the cylinder 22 below the piston 26 and in the line 88 assuming a relatively evenly distributed load on the arms 38, 40. In different cases, of course, particularly where unevenly distributed bearing loads are involved, the maximum pressure ratio to which the valve 80 may be set to open may be greater than 1:4 but this would have to be determined through some experimentation with the particular lift assembly employed and load to be raised and lowered thereby.

I also find that for best results the pressure in the spring 102 should be set at from about 400 to 600 psi when the valve 82 is in an open state. Obviously, some variation above and below these pressure levels may be found acceptable in some cases. The purpose of the spring 102 is to provide a preselected minimum bias upon the valve 82 to maintain the latter in an open position during the brief time interval between the time when the wheels of a vehicle closest to the arm 38 descend into engagement with the independent supporting surface or floor upon which the assembly 10 rests and the time when the vehicle wheels closest to the arm 40 engage the floor. The vehicle wheels closest to the arm 38 will probably engage the floor before the vehicle wheels nearest the arm 40 do so because the drive cylinder 22 is designed to allow the piston 26 to travel slightly further in a given time period than the piston 28 as previously indicated so as to assure that, during ascent, the piston 26 will reach the top of its stroke before piston 28 does so. When descent is initiated, the piston 26 must necessarily start downward before the piston 28 and, due to the slight volumetric differences designed into the cylinders 22, 24, the former piston will reach its lowest position slightly ahead of the latter piston. A fluid bypass slot 120 formed in the base of the defining wall of the cylinder 22 allows hydraulic fluid to flow around the piston 26, when at its lowest position, to the reservoir 12 to permit piston 28 to thereafter also reach its lowest position. While the volumetric difference of the cylinders is very slight and will not in and of itself cause a serious or even troublesome misalignment between the arms 38, 40, it is necessary to take the difference into consideration for proper operation of the circuit 16. Without the minimum amount of bias afforded by the spring 102, the valve 82 could, under certain circumstances, shift to its closed position during the aforementioned brief time interval due to a reduction of loading on the arm 38 as the vehicle wheels closest thereto and the vehicle frame along the same side settle upon the floor. The valve 82 could thus falsely perceive that the vehicle supporting structure 18, 38 has become jammed or restrained from further descent. Such action by the valve 82 would, therefore, prevent further descent of the pistons 26, 28 to their lowest positions possibly leaving a full or nearly full load upon the arm 40 so that the vehicle could not be driven off of the lift assembly.

The bias pressure in the spring 114 need only be sufficient to assure positive response of the valve 86 thereto so that it returns to its closed state when the manually operated lever 116 holding the same in its open state is released. It will be understood that the circuit of my invention will be useful to control piston descent in any dual post hydraulically operated lift assembly having drive and idler cylinders whose piston rods are not fixedly attached either directly or indirectly through other rigid members such as lifting posts, to carriage arms. An alternative type of dual post hydraulic lift with which my invention could be used, for example, would be one in which the cylinder piston rods bear against a pair of rigid upper surfaces or caps of the posts without being fixedly attached thereto such that, while the rods bear against the caps to force the posts upwardly, they could retract downwardly from extended positions upon command whether or not the posts were jammed, restrained or blocked from descending.

It will also be recognized that the rigid hydraulic flow line 54 extending between the cylinders 22, 24 can readily be fashioned to extend over and above the upper surface of a vehicle or other article supported on the arms 38, 40 when the latter are raised to their highest attainable positions. Because the rigid line is readily self-supporting for overhead disposition and because the circuit of my invention eliminates the need for a chain connected through pulleys between the article supporting structures 18, 38 and 20, 40 which would extend across the floor between the housings 50, 52, all essential interconnections between the components in the housings 50, 52 can now be removed from the floor therebetween, which is yet another distinct advantage afforded by my invention.

It will also be appreciated by those skilled in the art that modern manufacturing processes now make it possible to obtain two cylinders, one, a double acting and, the other, a single acting cylinder, like the cylinders 22 and 24 whose effective piston chamber areas, i.e., the area of the piston chamber of cylinder 22 less the area of the piston rod 30 and the area of the piston chamber of the cylinder 24, are very nearly equal to one another. Any difference between the two aforementioned areas can be reduced to the point where it is negligible. In such cases, it is not necessary to deliberately design a volumetric difference into the two cylinders 22, 24 and they can be designed to have essentially equal effective piston chamber areas as aforesaid as well as essentially equal cylinder bore lengths. It has been determined that double and single acting cylinders manufactured by Massey-Ferguson, Incorporated, Pacoma Division, P.O. Box 697, Wayne, Mich. 48184, can be obtained wherein the cylinder volumes are so nearly equal as to make them readily usable with the circuit of the present invention. Of course, where such near equality cannot be obtained, it will still be necessary to deliberately design slight volumetric differences into the cylinders 22, 24 since, as a practical matter, the pistons 26, 28 must either reach the top of their respective strokes together or else piston 26 must reach the top of its stroke first in order to assure that the piston 28 will thereafter also be able to reach the top of its stroke.

Although the present invention has been explained with respect to specific details of a certain preferred embodiment thereof, it is not intended that such details limit the scope of my invention otherwise than as specifically and positively set forth in the following claims.

I claim:

1. For use with a dual post article lift assembly of the type which includes a hydraulically operated drive cylinder containing a movable piston connected to a piston rod, a hydraulically operated idler cylinder containing a movable piston connected to a piston rod, said cylinders being hydraulically connected in series such that upward and downward movements of said idler piston are dependent upon corresponding movements of said drive piston, and article supporting means nonfixedly connected to each of said rods such that upward movements of said pistons produce upward movements of said article supporting means and such that downward movement of said pistons occur independently of movement of said supporting means, a fluid operated control circuit comprising first valve means connectable for fluid flow therethrough between a lower end of said drive cylinder and a fluid reservoir and responsively connectable to both of said cylinders for preventing said drive piston from descending when the supporting means associated with said idler cylinder is restrained from descending, second hydraulically actuated valve means being a first two position control valve having an open and a closed position and being series connected for fluid flow therethrough with said first valve means between said lower end of said drive cylinder and said fluid reservoir and being responsively connectable to lower ends of both of said cylinders for preventing said drive piston from descending when the supporting means associated with said drive cylinder is restrained from descending, spring biasing means connected to said first control valve for providing a preselected minimum bias pressure tending to maintain said first control valve in an open position, fluid biasing means connectable between a lower end of said drive cylinder and said first control valve tending to maintain said first control valve in an open position in cooperation with said spring biasing means, and fluid counterbiasing means connectable between a lower end of said idler cylinder and said first control valve for forcing the latter to shift to a closed position in opposition to said spring and fluid biasing means when the fluid pressure in said idler cylinder becomes greater than the sum of the fluid pressure in the lower end of said drive cylinder and the pressure of said spring biasing means, indicative that the supporting means associated with said drive cylinder is restrained from descending while said pistons are descending.

2. The circuit of claim 1 further comprising a second two position control valve connected to said second valve means and having open and closed positions for selectively draining hydraulic fluid passing from said drive cylinder through said first and second valve means to a reservoir, and first spring biasing means connected to said second control valve tending to maintain said second control valve in a closed position, said second control valve being manually adjustable to an open state in opposition to said first spring biasing means to permit said draining.

3. The circuit of claim 1 further comprising fluid by-pass valve mans connected in shunting relation across said first two position control valve for permitting hydraulic fluid to be pumped therethrough and thence through said first valve means to said drive cylinder to increase the fluid pressure in a lower end of said drive cylinder when said first control valve is in a closed position.

4. The circuit of claim 1 wherein said minimum bias pressure is adjustable to a level such that said first control valve remains in an open state during a time interval between a time when a load carried by the supporting means associated with said drive cylinder descends into engagement with an independent supporting surface such that the weight carried by said drive cylinder supporting means begins to decrease, and a time when a load carried by the supporting means associated with said idler cylinder descends into engagement with an independent supporting surface such that the weight carried by said idler cylinder supporting means begins to decrease whereby hydraulic fluid in a lower end of said drive cylinder continues to drain therefrom such that said pistons continue to descend toward their lowest positions.

5. The circuit of claim 1 wherein said minimum bias pressure is between about 400 and 600 psi.

6. The circuit of claim 1 further comprising by-pass valve means connecting in shunting relation across said second valve means for permitting the pumping of hydraulic fluid therethrough and thence through said first valve means to a lower end of said drive cylinder when said second valve means is in a closed position.

7. The circuit of claim 4 wherein said by-pass valve means comprises a check valve.

8. The circuit of claim 1 wherein said first valve means comprises a pilot operated check valve.

9. The circuit of claim 8 wherein said pilot operated check valve is adapted to open and remain open for drainage of hydraulic fluid from said drive cylinder therethrough when and so long as the ratio of fluid pressure in a lower end of said idler cylinder to fluid pressure in a lower end of said drive cylinder is at least equal to a preselected fraction indicative that the article supporting means associated with said idler cylinder is free to descend as said idler cylinder piston descends.

10. The circuit of claim 9 wherein said fraction is not less than about one-sixth nor greater than about one-fourth.

11. For use with a dual post article lift assembly of the type which includes a hydraulically operated drive cylinder containing a movable piston connected to a piston rod, a hydraulically operated idler cylinder containing a movable piston connected to a piston rod, said cylinders being hydraulically connected in series such that upward and downward movements of said idler cylinder piston are dependent upon corresponding movements of said drive cylinder piston, and article supporting means nonfixedly connected to each of said rods such that upward movements of said pistons produce upward movements of said article supporting mean and such that downward movements of said pistons occur independently of movements of said supporting means, a fluid operated circuit for controlling the descent of said pistons comprising a pilot operated check valve connectable for fluid flow therethrough to a lower end of said drive cylinder and responsively connectable to the lower ends of both of said cylinders for opening and remaining open for fluid flow therethrough when and so long as the ratio of the pressure of a fluid in a lower end of said idler cylinder to the pressure of a fluid in the lower end of said drive cylinder is at least as great as a predetermined minimum value indicative that the article supporting structure associated with said idler cylinder is unrestrained and free to descend as said pistons descend, said first valve being adapted to close to prevent the drainage of a fluid from said drive cylinder when said ratio is less than said value, a first two-position control valve having an open and a closed position connected for fluid flow therethrough to said pilot operated check valve, spring biasing means connected to said first valve and adapted to provide a preselected minimum bias pressure on said first valve which tends to maintain said first valve in an open position, fluid biasing means responsively connectable to the lower end of said drive cylinder and operatively associated with said first valve tending to maintain said first valve in an open position, fluid counterbiasing means responsively connectable to the lower end of said idler cylinder and operatively associated with said first valve in opposing relation to said spring and fluid biasing means for shifting said first valve to a closed position when the pressure of a fluid in the lower end of said idler cylinder exceeds the sum of the pressures of a fluid in the lower end of said drive cylinder and said spring biasing means indicative that the article supporting means associated with said drive cylinder is restrained from descending while said pistons are descending, and a second check valve connected in shunting relation across said first valve and being adapted to close when said first valve is in an open position and being adapted to open to permit hydraulic fluid to be pumped around said first valve, to and through said pilot operated valve and into said drive cylinder when said first valve is closed so that the fluid pressure in said drive cylinder will be raised to shift said first valve from a closed to an open position.

* * * * *